US005342178A

United States Patent [19]

Kimura et al.

[11] Patent Number: 5,342,178

[45] Date of Patent: Aug. 30, 1994

[54] COOLANT GAS GUIDING MECHANISM IN COMPRESSOR

[75] Inventors: Kazuya Kimura; Hiroaki Kayukawa; Shigeyuki Hidaka; Yoshihiro Fujisawa, all of Kariya, Japan

[73] Assignee: Kabushiki Kaisha Toyoda Jidoshokki Seisakusho, Kariya, Japan

[21] Appl. No.: 10,595

[22] Filed: Jan. 28, 1993

Related U.S. Application Data

[63] Continuation-in-part of Ser. No. 963,850, Oct. 20, 1992.

[30] Foreign Application Priority Data

Jan. 29, 1992 [JP] Japan ..... 4-014248

[51] Int. Cl.[5] ..... F04B 1/14

[52] U.S. Cl. ..... 417/269; 417/500; 417/222.2

[58] Field of Search ..... 417/269, 222.1, 222.2, 417/500; 137/625.11, 624.13

[56] References Cited

U.S. PATENT DOCUMENTS

| | | | |
|---|---|---|---|
| 2,160,978 | 6/1939 | Mock | 417/269 |
| 2,663,492 | 12/1953 | Eaton | 417/203 |
| 4,007,663 | 2/1977 | Nagatomo et al. | 417/269 |
| 5,207,078 | 5/1993 | Kimura et al. | 417/269 |
| 5,232,349 | 8/1993 | Kimura et al. | 417/222.1 |
| 5,286,173 | 2/1994 | Takenaka et al. | 417/269 |

*Primary Examiner*—Richard A. Bertsch
*Assistant Examiner*—Peter Korytnyk
*Attorney, Agent, or Firm*—Brooks Haidt Haffner & Delahunty

[57] ABSTRACT

A coolant gas guiding mechanism in a compressor is disclosed. A plurality of pistons reciprocate within corresponding cylinder bores that are formed around the rotary shaft, inside a casing. Each piston defines a working chamber in the corresponding cylinder bore. A rotary valve is provided coaxially with a rotary shaft. The rotary shaft has a suction chamber, an inlet through which the coolant gas is sucked in from external coolant circuit, and an outlet which communicates with a selected one of the working chambers in synchrony with the reciprocating movement of the piston, for supplying the coolant gas to the working chamber.

12 Claims, 3 Drawing Sheets

COOLANT GAS GUIDING MECHANISM IN COMPRESSOR

CROSS REFERENCE TO RELATED APPLICATIONS

This is a continuation in part application of U.S. application Ser. No. 07/963,850, filed on Oct. 20, 1992, which is incorporated herein by reference.

BACKGROUND OF THE INVENTION

1. Field of the Invention

The present invention relates to a coolant gas guiding mechanism in a compressor.

2. Description of the Related Art

A conventional wobble plate type compressor is shown in FIG. 4 as having a housing 52 with a suction chamber 50, and a discharge chamber 51. The suction and discharge chambers 50, 51 are separately disposed with respect to each other. Cylinder bores 53 are formed in a cylinder block 54. A valve plate 55 has a suction port 55*a* formed therein. A suction plate 56 has a flapper type suction valve 56*a* formed therein. The valve plate 55 is disposed between the cylinder block 54 and the housing 52. The suction plate 56 is located adjacent to the valve plate 55.

A working chamber 59, is defined by a piston 58 and the cylinder bore 53. When the piston 58 moves leftward, pressure inside the working chamber 59 decreases. The suction valve 56*a* is elastically deformed to open the suction port 55*a*, in order to allow the coolant gas in the suction chamber 50 to be sucked in, via the suction port 55*a*, into the working chamber 59. When the piston 58 moves rightward, after the suction operation is completed, pressure in the working chamber 59 rises, so that the suction valve 56*a* closes the suction port 55*a*.

Thereafter, when pressure in the working chamber 59 rises to, or above a predetermined level, the discharge valve 57*a* elastically deforms, and causes the discharge port 55*b* to open, via the discharge valve 57*a*, in order to discharge the compressed coolant gas from the working chamber 59, into the discharge chamber 51.

The suction valve 56*a* is designed to elastically regulate the opening of the suction port 55*a* as a function of the change in the suction pressure of the coolant gas. This design requires that the pressure of the coolant gas, in the suction chamber 50, be raised above that in the working chamber 59, in order to cause the suction valve 56*a* to be elastically deformed and to open the suction port 55*a*. Consequently, the opening response of the suction valve 56*a* is delayed with respect to the movement of the piston 58.

Furthermore, lubricant oil is mixed with the coolant gas, and collects on the suction valve 56*a*. Therefore, when the suction valve 56*a* elastically deforms to open the suction port 55*a*, oil might cause the suction valve 56*a* to adhere to the suction port 55*a*, thus adversely affecting the suction response.

Even when the suction valve 56*a* is opened, the suction response of the flapper type valve, which is elastically deformable, and which acts as suction resistance against the coolant gas to be sucked, is decreased by the design problem of the flipper type valve. Therefore, the decrease in the suction response results in a corresponding decrease of the amount of the coolant gas sucked into the working chamber 59, and an increase of the pressure loss in the compressor.

The coolant gas compressed in the working chamber 59 is discharged into the discharge chamber 51 at high temperature. Thus, the internal temperature of the discharge chamber 51 is also raised. In the conventional compressor, the suction chamber 50 and the discharge chamber 51 are adjacently located. The coolant gas introduced into the suction chamber 50, from an external coolant gas circuit, will expand its volume, due to heat transmitted from the discharge chamber 51 to the suction chamber 50. Therefore, the density of the coolant gas is caused to decrease, prior to letting it into the working chamber 59. This decrease results in density results in a decrease of the compressed volume in the working chamber, and in an increase of the pressure loss in the compressor.

Further, the elastic deformation of the flapper type valve is repeated and generates vibration. Corresponding pulsation is generated in the pressure within the suction chamber 50, and generates noise.

SUMMARY OF THE INVENTION

Accordingly, an object of the present invention is to overcome the foregoing problems, and to provide a coolant gas guiding mechanism in a compressor, which decreases pressure loss, and suppresses noise.

To achieve the above objects, a coolant gas guiding mechanism in a compressor for compressing and discharging the coolant gas supplied from an external coolant circuit is disclosed. The compressor includes a casing, a rotary shaft disposed in the casing, and a plurality of cylinder bores disposed around the rotary shaft in the casing. Pistons are reciprocatingly disposed in the cylinder bores, respectively, and a working chamber is defined by the piston in each cylinder bore. A rotary valve of the coolant gas guiding mechanism is disposed coaxially with the rotary shaft. The valve has a suction chamber therein, an inlet inducing the coolant gas to flow from the external coolant circuit and an outlet selectively communicated with the working chambers in synchronism with the reciprocating movement of the piston for supplying the coolant gas in the working chamber.

BRIEF DESCRIPTION OF THE DRAWINGS

The features of the present invention that are believed to be novel are set forth with particularity in the appended claims. The invention, together with the objects and advantages thereof, may best be understood by reference to the following description of the preferred embodiments, together with the accompanying drawings in which:

DETAILED DESCRIPTION OF THE PREFERRED EMBODIMENT

A preferred embodiment of a coolant gas guiding mechanism in a wobble plate type compressor, according to the present invention, will now be described.

Figure 1:
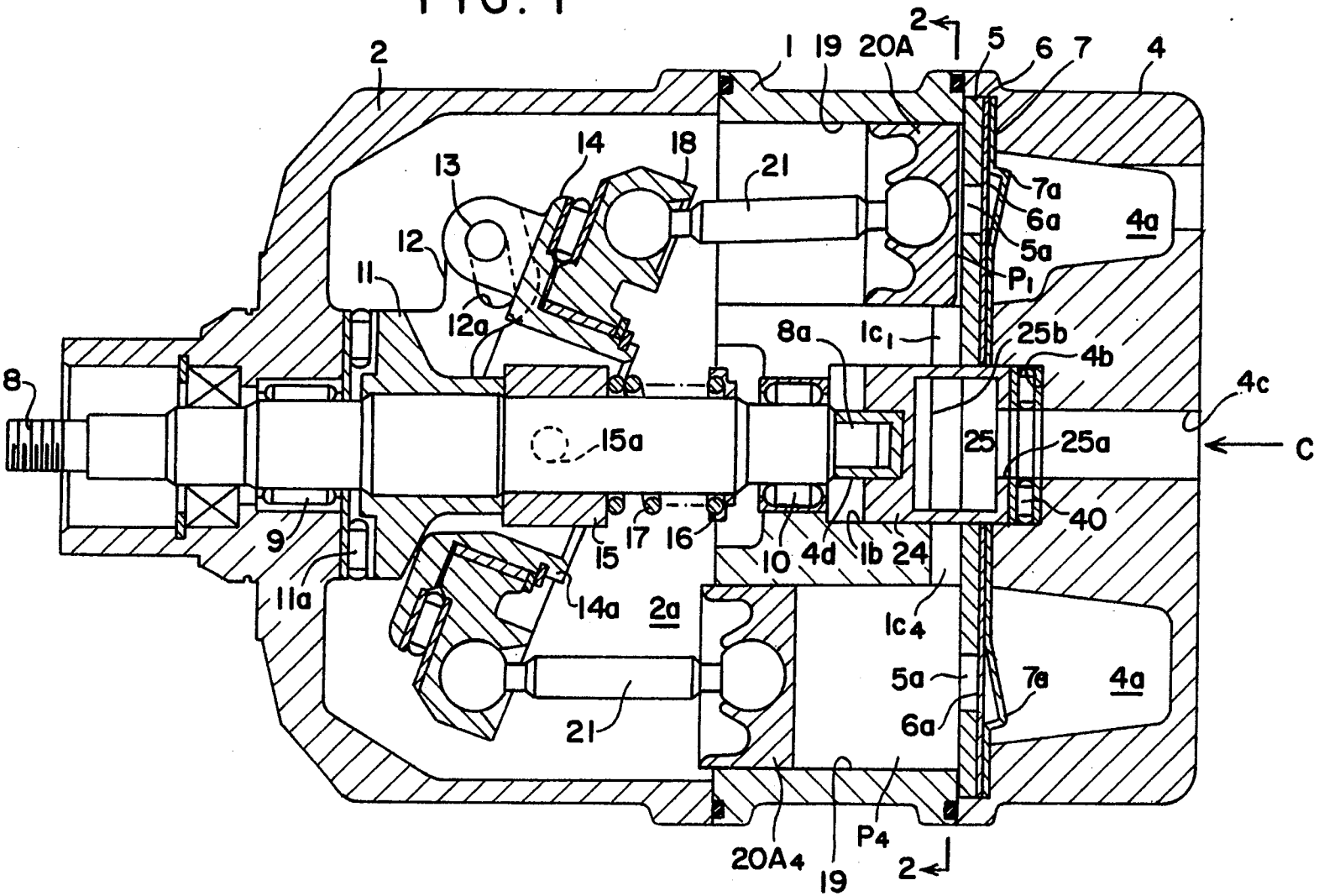
FIG. 1 is a cross sectional view showing a compressor according to the present invention.

As shown in FIG. 1, a front housing 2 is connected to the front side of a cylinder block 1, and includes a crank case 2a formed therein. A rear housing 4 is securely connected, via a valve plate 5, to the rear side of the cylinder block 1. A discharge chamber 4a is formed in the rear housing 4. A discharge plate 6 and a retainer plate 7 are disposed between the valve plate 5 and the rear housing 4. Each one of discharge openings 5a is designed to open via a corresponding flap type discharge valve 6a formed in the discharge plate 6. The opening position of each discharge valve 6b is regulated by a corresponding retainer 7a formed in the retainer plate 7.

A rotary shaft 8 is rotatably supported between the cylinder block 1 and the front housing 2, by means of radial bearings 9 and 10. A drive plate 11 is fixed to the rotary shaft 8 in the front housing 2, with a thrust bearing 11a disposed between the front end of the drive plate 11, and the inner wall of the front housing 2. The thrust bearing 11a receives a compressive reaction force when a coolant gas is compressed. A support arm 12 is formed on the outer surface of the drive plate 11. A slider 15 is fitted over the rotational shaft 8, and is slidable in the axial direction. A spring sheet 16 is secured to the rotary shaft 8, with a spring 17 disposed between the spring sheet 16 and the slider 15. The slider 15 is urged toward the drive plate 11 by the spring 17.

A pair of pins 15a (only one is shown) protrude perpendicularly to the rotary shaft 8, and are attached to the slider 15. A rotary plate 14 is supported, at its support portion 14a, on the pins 15a, so as to be swingable along the axis of the rotary shaft 8. An elongated hole 12a is formed in the free end of the support arm 12, and a pin 13 is fitted slidably in the hole 12a. The rotary plate 14 is coupled tiltably to the drive plate 11, via the pin 13. A wobble plate 18 is mounted at the support portion 14a of the rotary plate 14, in order to be rotatable relative to the support portion 14a.

A plurality of cylinder bores 19 (in this embodiment, the number of bores is six) are formed in the cylinder block 1, equidistantly from, and in parallel to the rotary shaft 8. Each cylinder bore 19 communicates with the crank case 2a. Pistons 20A1 through 20A6 are fitted reciprocatingly in the corresponding cylinder bores 19, one piston in each bore 19, with a working chamber P1 through P6 defined between each piston 20Aj (j=1 through 6) and the valve plate 5. Each piston 20Aj is coupled to the wobble plate 18, by means of a piston rod 21. The rotational motion of the rotary shaft 8 is thus converted to a reciprocating back-and-forth motion of the wobble plate 18, via the drive plate 11, and the rotary plate 14. Accordingly, each piston 20Aj moves forward and backward in its associated cylinder bore 19, so as to cause the coolant gas to be sucked in, compressed and discharged.

Accommodating chambers 1b and 4b are defined, respectively, between the opposing faces presented by the distal surface of the cylinder block 1 and the rear housing 4. The distal portion 8a of the rotary shaft 8 protrudes into the accommodating chamber 1b of the cylinder block 1. A rotary valve 24 is rotatably held between the distal surfaces of the accommodating chambers 1b and 4b. A thrust bearing 40 is disposed between the distal surfaces of the accommodating chamber 4b and the rotary valve 24.

Figure 2:
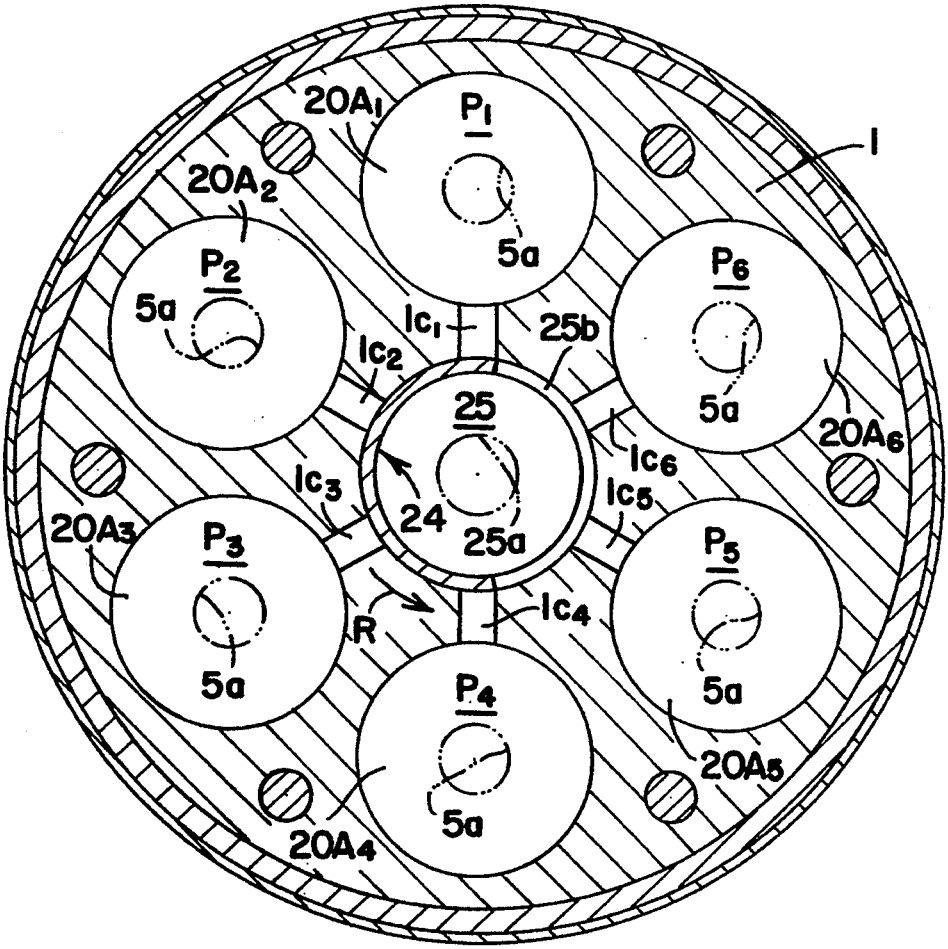
FIG. 2 is a cross sectional view taken along the line 2—2 of FIG. 1.

A coupling 41 is secured to the distal surface of the rotary valve 24, which is located on the side of the accommodating chamber 1b. A protruding portion 8a of the rotary shaft 8, which protrudes into the accommodating chamber 1b, and the coupling 41, are fitted together. The rotary valve 24 is integrally rotatable with the rotary shaft 8 and the coupling 41, within the accommodating chambers 1b and 4b, and rotates in the direction indicated by the arrow R, as shown in FIG. 2. The thrust bearing 40 receives the thrust load which is applied to the rotary valve 24.

Figure 3:
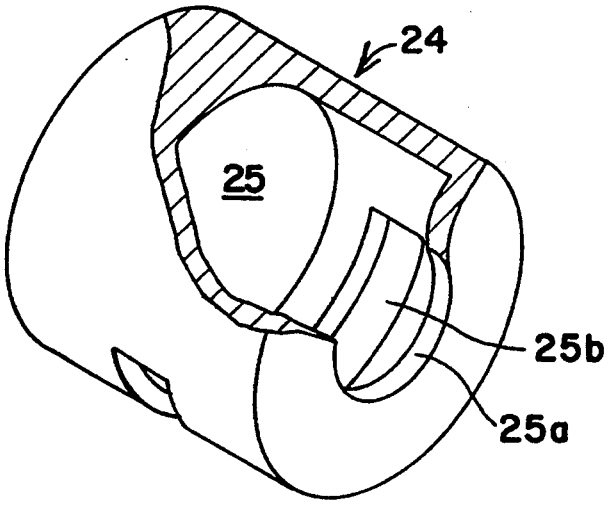
FIG. 3 is a perspective view showing a rotary valve.
Figure 4:
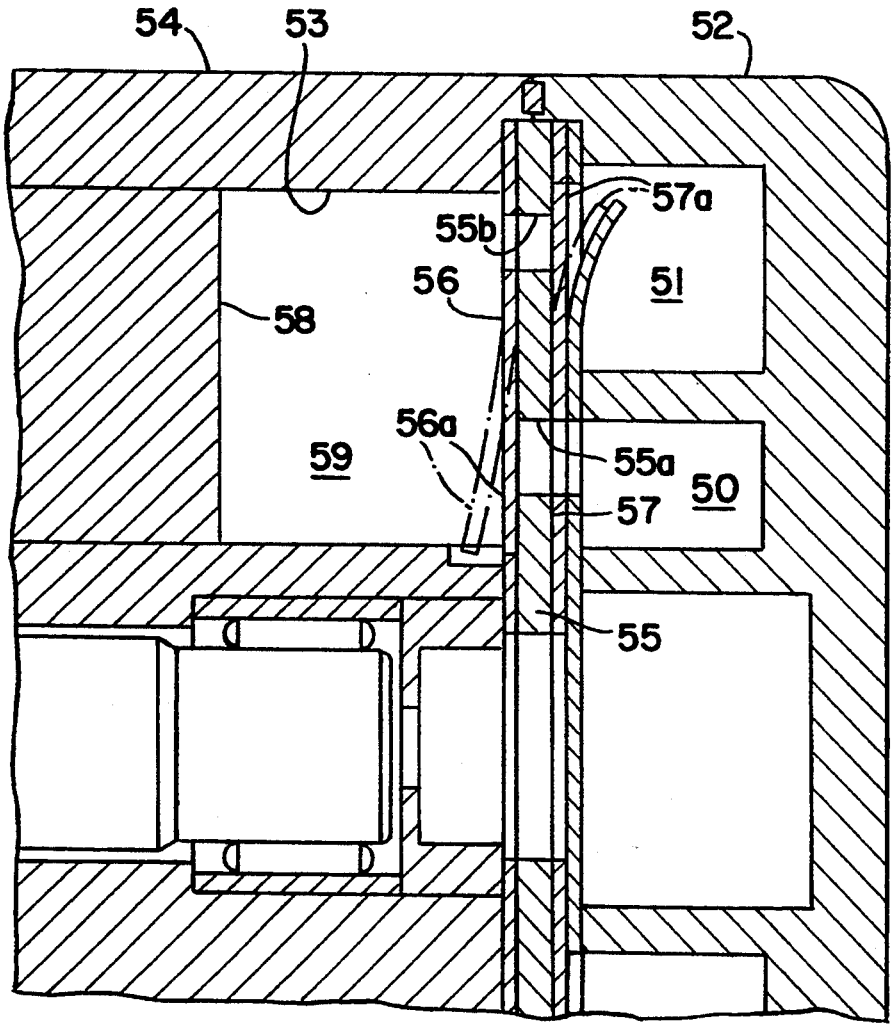
FIG. 4 (PRIOR ART)
FIG. 4 is a fragmented cross sectional view showing the conventional compressor.

A suction chamber 25 is defined in the rotary valve 24. An inlet 25a of the suction chamber 25 is formed in the distal surface of rotary valve 24 which leads to the accommodating chamber 4b. An outlet 25b is formed through and part-way along less than one-half of the rotary valve 24 in the form of a slit as seen in FIG. 3. An induction opening 4c is formed at the central portion of the rear housing 4, and communicates with the accommodating chamber 4b. The inlet 25a of the accommodating chamber 25 is interconnected with the inductive opening 4c. Suction ports 1c1, 1c2, 1c3, 1c4, 1c5 and 1c6 are equidistantly formed along the outer periphery of the accommodating chamber 1b. The number of suction ports is equal to that of the working chambers P1 through P6. The suction ports 1cj and the working chambers Pj (j=1 through 6) are always interconnected to each other, according to the number of j. Each suction port 1cj can be connected to the surrounding area of the associated outlet 25b of the suction chamber 25 by rotation of valve 24, as seen in FIG. 2.

The operation of the present compressor will now be described in detail. As shown in FIGS. 1 and 2, the piston 20A1 is positioned at its upper dead point. The piston 20A4, which is oppositely (180 degrees) disposed with respect to the piston 20A1, is positioned at its lower dead point. When the pistons 20A1 and 20A4 are positioned at the above-described points, the outlet 25b is disposed between both pistons 20A1 and 20A4, and is not connected to the suction ports 1c1 and 1c4, as seen in FIG. 2.

While the piston 20A1 is shifting its position from the upper dead point to the lower dead point, in other words, when the piston 20A1 is performing the suction operation, the suction chamber 25 is interconnected to the working chamber P1 via the opening 35b, so that the coolant gas, supplied through the induction opening 4c, is sucked into the working chamber P1, via the suction chamber 25 of the rotary valve 24. On the other hand, while the piston 20A4 is shifting its position from the lower dead point to the upper dead point, in other words, when the piston 20A4 is performing the discharge operation, the suction chamber 25 is disconnected from the working chamber P4.

The suction of the coolant gas is performed similarly in the other working chambers P1 through P3, P5 and P6.

While the piston 20Aj is shifting from the lower dead point to the upper dead point, in other words, when the piston 20Aj is performing the discharge operation, the coolant gas sucked into the working chamber Pj is discharged into the discharge chamber 4a, while the coolant gas is compressed. In this case, the piston 20Aj varies its stroke relative to the pressure difference between the internal pressure in the crank case 2a, and the suction pressure in the working chamber Pj, so that the tilting angle of the wobble plate 18, which causes the compression volume to vary, is varied. The internal pressure in the crank case 2a is employed to supply the coolant gas, which is in the compressed discharge area, into the crank case 2a, and is controlled by discharging the coolant gas in the crank case 2*a* into the compressed suction area, by means of a control valve mechanism (not shown).

In the flapper type suction valve employed in the conventional type compressor, the lubricant oil increases the adhesion between the suction valve and the corresponding surface. Therefore, the time it takes the suction valve to open is extended due to the oil deposit. This delay causes the suction resistance generated by the elastic resistance of the suction valve, and the volume expansion rate, due to the thermal expansion of the coolant gas, to decrease.

However, in the compressor employing the rotary valve which is forced to rotate, the oil deposit and the suction resistance do not cause any problem. When the pressure in the working chamber Pj is lower than a predetermined level, the coolant gas is immediately supplied into the working chamber Pj. The coolant gas, which is supplied into the suction chamber Pj from an external coolant gas circuit, passes through the suction chamber 25 of the rotary valve 24, which is remotely located relative to the discharge chamber 4*a*. Thus, the thermal expansion of the coolant gas is controlled. As a result, the compressor, which employs the rotary valve 24, has a significantly improved valve response to the pressure of the sucked gas, compared to the conventional compressor which uses a flapper type suction valve.

The added volume of the working chambers Pj which are interconnected with the corresponding outlet 25*b*, fluctuates relative to the rotational angle of the wobble plate 18. This volume fluctuation generates suction pulsation. In other words, the volume of the coolant gas to be sucked, varies relative to the variation of the rotational angle of the wobble plate 18. When this pulsation influences the external coolant gas circuit, noise is increased.

The suction pulsation influence on the external coolant gas circuit is controlled by providing the suction chamber 25 in the rotary valve 24; that is, in the coolant gas passage between the induction opening 4*c*, which is a connecting opening to the external coolant gas circuit, and the working chambers Pj. The cross-sectional area of the suction chamber 25 is larger than that of the inlet 25*a*, and also larger than that of the suction ports 1*cj*, which are interconnected to the outlet 25*b*. Therefore, the suction pulsation generated by adding the volumes of the working chambers Pj which are concurrently interconnected to the outlet 25*b* of the suction chamber 25, is reduced. As a result, noise generated by the suction pulsation is reduced.

When the piston 20Aj is at the upper dead point, the coolant gas remains in the working chamber Pj. Consequently, while the piston 20Aj is performing the suction operation, the volume of the remaining coolant gas expands, and the gas back flows from the suction port 1*cj* into the side of the suction chamber 25. The back flow of this high pressured coolant gas also generates pulsation. However, the suction chamber 25 controls the pulsation generated by the back flow.

In the above-mentioned expansion type noise elimination mechanism, noise is decreased significantly as the cross-sectional area of the suction chamber 25 increases. Therefore, it is desirable to increase the volume of the suction chamber 25 while the necessary structural strength of the rotary valve 24 should be maintained at a predetermined level.

Although only one embodiment of the present invention has been described herein, it should be apparent to those skilled in the art that the present invention may be embodied in many other specific forms without departing from the spirit or scope of the invention.

What is claimed is:

1. A coolant gas guiding mechanism in a compressor, for compressing and discharging the coolant gas supplied from an external coolant circuit, said mechanism comprising;

a casing;

a rotary shaft disposed in said casing;

a plurality of cylinder bores disposed around said rotary shaft;

a plurality of pistons mounted for reciprocating movement within the respective of said cylinder bores;

a working chamber defined by each piston in its corresponding cylinder bore; and a rotary valve disposed coaxially and connected for rotation with the rotary shaft and having a hollow central suction chamber and an inlet through which the coolant gas is introduced into said central suction chamber from an external coolant circuit, and an outlet from said central suction chamber communicating concurrently with a selected plurality, but fewer than all of said working chambers in synchrony with the reciprocating movements of said pistons for supplying the coolant gas to the working chamber.

2. A coolant gas guiding mechanism according to claim 1, further including a wobble plate connected to said pistons, for causing said pistons to reciprocate in accordance with the rotation of said rotary shaft.

3. A coolant gas guiding mechanism according to claim 1 further including suction ports, each said suction port being connected to one of said working chambers, and being sequentially connected to said rotary valve suction chamber via said outlet of said rotary valve in accordance with the rotation of said rotary shaft.

4. A coolant gas guiding mechanism according to claim 3, wherein said outlet of said rotary valve is provided by a circumferentially extending slit through and part-way along the periphery of said rotary valve.

5. A coolant gas guiding mechanism according to claim 4, wherein each piston reciprocates in a corresponding one of said working chambers, for increasing and lowering the inner pressure of the working chamber, whereby the coolant gas is discharged from, and sucked into the compressor.

6. A coolant gas guiding mechanism according to claim 5, wherein said suction chamber is sequentially connected to each one of said working chambers when said piston therein is causing the coolant gas to be sucked therein, and is disconnected from said working chamber when said piston therein is causing the coolant gas to be discharged therefrom.

7. A coolant gas guiding mechanism according to claim 3, wherein the cross-sectional area of the suction chamber is larger than that of said inlet.

8. A coolant gas guiding mechanism in a compressor, for compressing and discharging the coolant gas supplied from an external coolant circuit, said mechanism comprising;

a casing;

a rotary shaft disposed in said casing;

a plurality of cylinder bores disposed around said rotary shaft;

a plurality of pistons mounted for reciprocating movement within the respective of said cylinder bores, each said piston moving between a lower dead point and an upper dead point within its said associated cylinder;

a working chamber defined by each piston in its corresponding cylinder bore;

a rotary valve disposed coaxially and connected for rotation with the rotary shaft and having a hollow central suction chamber and an inlet through which the coolant gas is introduced into said control suction chamber from an external coolant circuit, the cross-sectional area of said suction chamber being larger than the cross-sectional area of said inlet, and an outlet for sequentially communicating with a selected plurality, but fewer than all of said working chambers in synchrony with the reciprocating movements of said pistons for supplying the coolant gas to the working chambers; and a plurality of suction ports each connecting said suction chamber and said plurality of working chambers when the pistons in said plurality of working chambers are moving toward their said lower dead points, and said rotary valve sequentially disconnecting said suction chamber from each of said working chambers when said piston in the working chamber is moving toward its said upper dead point.

9. A coolant gas guiding mechanism according to claim 8, further including a wobble plate connected to said pistons, for causing said pistons to reciprocate is accordance with the rotation of said rotary shaft.

10. A coolant gas guiding mechanism according to claim 8, wherein said outlet of said rotary valve is provided by a circumferentially extending slit through the periphery of said rotary valve.

11. A coolant gas guiding mechanism in a compressor, for compressing and discharging the coolant gas supplied from an external coolant circuit, said mechanism comprising;

a casing;

a rotary shaft disposed in said casing;

a plurality of cylinder bores disposed around said rotary shaft;

a plurality of pistons mounted for reciprocating movement within the respective of said cylinder bores;

a wobble plate connected to said pistons, for causing said pistons to reciprocate in accordance with the rotation of said rotary shaft;

a working chamber defined by each piston in its corresponding cylinder bore;

a rotary valve disposed coaxially and connected for rotation with the rotary shaft for causing the coolant gas to be sucked into the casing from an external coolant circuit, said rotary valve communicating with a plurality, but fewer than all of said working chambers in synchrony with the reciprocating movements of said pistons for supplying coolant gas to each working chamber, said rotary valve being cylindrical and including a suction chamber therein, an inlet through which the coolant gas is sucked into said suction chamber from the external coolant circuit, the cross sectional area of said suction chamber being larger than the cross-sectional area of said inlet, and an outlet communicating with a selected plurality, but fewer than all of said working chambers, in accordance with the rotation of the rotary shaft; and a plurality of suction ports, each port connecting said suction chamber to one of said working chambers when the inner pressure of the working chamber is being lowered, and said rotary valve disconnecting said suction chamber from said working chamber when the inner pressure of the working chamber is being increased.

12. A coolant gas guiding mechanism according to claim 11, wherein said outlet comprises a circumferentially extending slit through and part-way along the peripheral surface of said rotary valve, said slit connecting said suction chamber sequentially with said plurality of said suction ports in accordance with the rotation of the rotary shaft.

* * * * *

UNITED STATES PATENT AND TRADEMARK OFFICE

CERTIFICATE OF CORRECTION

PATENT NO. : 5,342,178
DATED : August 30, 1994
INVENTOR(S) : K. Kimura et al

It is certified that error appears in the above-indentified patent and that said Letters Patent is hereby corrected as shown below:

Column 1, line 28 after "59" delete comma ",".

Column 3, line 11, after "valve" "6b" should read --6a--.

Column 4, line 13 after "the" insert --periphery of the--;
line 43, after "opening" "35b," should read --25b,--.

Column 6, line 23, start new line at "an".

Column 7, line 35, "is" should read --in--.

Signed and Sealed this

Thirty-first Day of January, 1995

*Attest:*

Bruce Lehman

BRUCE LEHMAN

*Attesting Officer*

*Commissioner of Patents and Trademarks*